US010943533B2

(12) United States Patent
Liu et al.

(10) Patent No.: US 10,943,533 B2
(45) Date of Patent: Mar. 9, 2021

(54) METHOD FOR DRIVING DISPLAY PANEL, DRIVING CHIP AND DISPLAY DEVICE

(71) Applicant: Shanghai Tianma AM-OLED Co., Ltd., Shanghai (CN)

(72) Inventors: Liyuan Liu, Shanghai (CN); Zhiyong Xiong, Shanghai (CN); Cuicui Zhang, Shanghai (CN); Xue Wang, Shanghai (CN); Ping An, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 16/420,461

(22) Filed: May 23, 2019

(65) Prior Publication Data

US 2020/0168149 A1 May 28, 2020

(30) Foreign Application Priority Data

Nov. 23, 2018 (CN) ..... 201811404215.4

(51) Int. Cl.
*G09G 3/3225* (2016.01)

(52) U.S. Cl.
CPC ... *G09G 3/3225* (2013.01); *G09G 2320/0257* (2013.01); *G09G 2320/0626* (2013.01)

(58) Field of Classification Search
CPC ..... G09G 3/3225; G09G 2320/0626; G09G 2320/0257
See application file for complete search history.

(56) References Cited

U.S. PATENT DOCUMENTS 7,528,805 B2 * 5/2009 Kao ..... G09G 3/2944 345/60
2004/0017162 A1 * 1/2004 Sato ..... G09G 3/3233 315/169.3
2009/0085907 A1 * 4/2009 Kim ..... G09G 3/3611 345/213

(Continued)

FOREIGN PATENT DOCUMENTS

CN 106023894 A 10/2016
CN 107016961 A 8/2017

OTHER PUBLICATIONS

Office Action dated Jan. 13, 2020 for corresponding Chinese Application No. 201811404215.4.

*Primary Examiner* — Grant Sitta
(74) *Attorney, Agent, or Firm* — Tarolli, Sundheim, Covell & Tummino LLP

(57) ABSTRACT

A method for driving a display panel, a driving chip and a display device are provided to ameliorate image retention and improve the display performance. The method includes: monitoring a static pattern in a first display image and defining an area where the static pattern is located as a first area when a display brightness value of the area and a display brightness value of an area where a background pattern thereof is located satisfy a first preset condition; and controlling the static pattern to move during displaying of the first display image, or adjusting grayscale values of sub-pixels in a second area during displaying of a second display image, to which the first display image jumps, the second area being an area, corresponding to the first area in the second display image and having a display brightness value lower than a display brightness value of the first area.

18 Claims, 6 Drawing Sheets

(56) References Cited

U.S. PATENT DOCUMENTS

| | | | | |
|---|---|---|---|---|
| 2011/0043534 | A1* | 2/2011 | Cheng | G09G 3/3406 345/589 |
| 2011/0242140 | A1* | 10/2011 | Lee | G09G 3/3648 345/690 |
| 2011/0273482 | A1* | 11/2011 | Massart | G09G 3/20 345/690 |
| 2013/0016114 | A1* | 1/2013 | Rabii | G09G 5/363 345/589 |
| 2013/0187937 | A1* | 7/2013 | Kerofsky | G09G 3/20 345/530 |
| 2013/0187958 | A1* | 7/2013 | Kimpe | G09G 5/10 345/690 |
| 2014/0055505 | A1* | 2/2014 | Ikeda | G09G 3/22 345/690 |
| 2014/0152722 | A1* | 6/2014 | Xi | G09G 3/3614 345/691 |
| 2015/0371579 | A1* | 12/2015 | Yu | G09G 3/2003 345/690 |
| 2018/0020142 | A1* | 1/2018 | Park | H04N 5/23216 |
| 2018/0108287 | A1* | 4/2018 | Jiang | G09G 3/3685 |
| 2018/0204509 | A1* | 7/2018 | Lu | H01L 51/56 |
| 2018/0302634 | A1* | 10/2018 | Bryant | H04N 19/115 |
| 2018/0338138 | A1* | 11/2018 | Zeng | G09G 3/3233 |

* cited by examiner

METHOD FOR DRIVING DISPLAY PANEL, DRIVING CHIP AND DISPLAY DEVICE

CROSS-REFERENCE TO RELATED APPLICATIONS

The present application claims priority to Chinese Patent Application No. 201811404215.4, filed on Nov. 23, 2018, the content of which is incorporated herein by reference in its entirety.

TECHNICAL FIELD

The present disclosure relates to the field of display technologies, and in particular, to a method for driving a display panel, a driving chip and a display device.

BACKGROUND

With the development of display technologies, an organic light-emitting diode (OLED) display panel has been more and more widely used due to its excellent characteristics such as self-illumination, high brightness, wide visual angle and fast response.

A pixel circuit of the OLED display panel includes a driving transistor and a plurality of switch transistors. For the existing pixel circuit, a threshold voltage shift of the driving transistor can be caused by manufacturing factors and aging of the transistor, although the uneven display problem resulted from the threshold voltage shift can be ameliorated by internal compensation, hysteresis effect of the driving transistor may cause image retention when the display panel is switched between an image having a high grayscale value and an image having a low grayscale value, which then influences the display performance.

SUMMARY

In view of this, the present disclosure provides a method for driving a display panel, a driving chip and a display device, so as to effectively ameliorate image retention and improve the display performance.

In an aspect, the present disclosure provides a method for driving a display panel, including: monitoring a static pattern in a first display image, and defining an area where the static pattern is located as a first area when a display brightness value of the area and a display brightness value of an area where a background pattern of the static pattern is located satisfy a first preset condition; and controlling the static pattern to move during displaying of the first display image; or adjusting grayscale values of sub-pixels in a second area during displaying of a second display image after the first display image jumps to the second display image, wherein the second area is an area, corresponding to the first area in the second display image and has a display brightness value lower than a display brightness value of the first area.

In another aspect, the present disclosure provides a driving chip, including: a first area positioning module configured to monitor a static pattern in a first display image, and to define an area where the static pattern is located as a first area when a display brightness value of the area and a display brightness value of an area where a background pattern of the static pattern is located satisfy a first preset condition; and a driving module electrically connected to the first area positioning module, and configured to control the static pattern to move during displaying of the first display image, or to adjust grayscale values of sub-pixels in a second area during displaying of a second display image after the first display image jumps to the second display image, wherein the second area is an area, corresponding to the first area in the second display image and has a display brightness value lower than a display brightness value of the first area.

In still another aspect, the present disclosure provides a display device including a display panel; and the driving chip described above. The driving chip is electrically connected to the display panel.

BRIEF DESCRIPTION OF DRAWINGS

In order to more clearly illustrate technical solutions in embodiments of the present disclosure, the accompanying drawings used in the embodiments are briefly introduced as follows. It should be noted that the drawings described as follows are merely part of the embodiments of the present disclosure, and other drawings can also be acquired by those skilled in the art without paying creative efforts.

DESCRIPTION OF EMBODIMENTS

For better illustrating technical solutions of the present disclosure, embodiments of the present disclosure will be described in detail as follows with reference to the accompanying drawings.

It should be noted that, the described embodiments are merely part of the embodiments of the present disclosure, but not all of the embodiments of the present disclosure. All other embodiments obtained by those skilled in the art without creative efforts according to those described embodiments of the present disclosure are within the scope of the present disclosure.

The terms used in the embodiments of the present disclosure are merely for the purpose of describing particular embodiments but not intended to limit the present disclosure. Unless otherwise noted in the context, objects defined by the singular form expressions "a", "an", "the" and "said" used in the embodiments and appended claims of the present disclosure are also intended to include plural form expressions thereof It should be understood that the term "and/or" used herein is merely an association relationship describing associated objects, indicating that there may be three relationships, for example, A and/or B may indicate three cases, i.e., only A exists, both A and B exists, and only B exists. In addition, the character "/" herein generally indicates that the related objects before and after the character have an "or" relationship.

It should be understood that although the display image may be described using the terms "first", "second", etc., in the embodiments of the present disclosure, the display image will not be limited to these terms. These terms are merely used to distinguish display images from one another. For example, without departing from the scope of the embodiments of the present disclosure, a first display image may also be referred to as a second display image, similarly, a second display image may also be referred to as a first display image.

Figure 1:
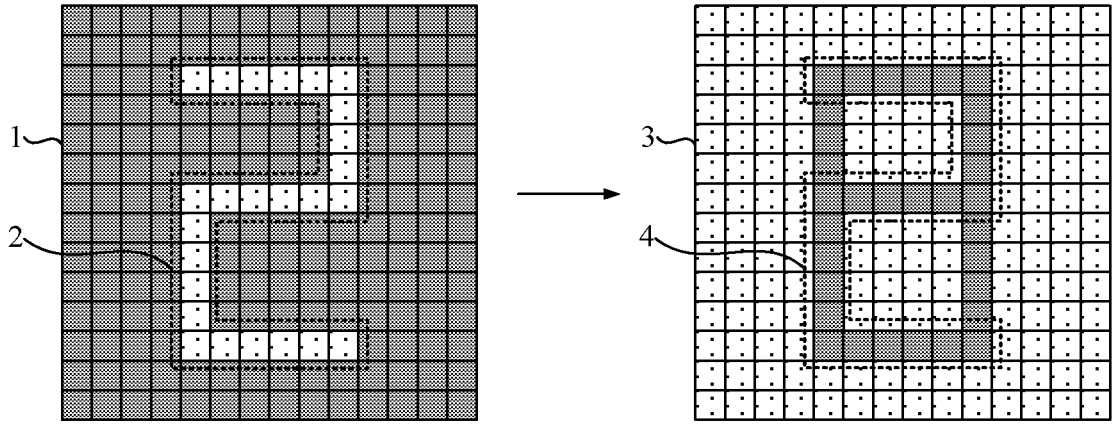
FIG. 1 is a schematic diagram of a first display image and a second display image according to an embodiment of the present disclosure.
Figure 2:
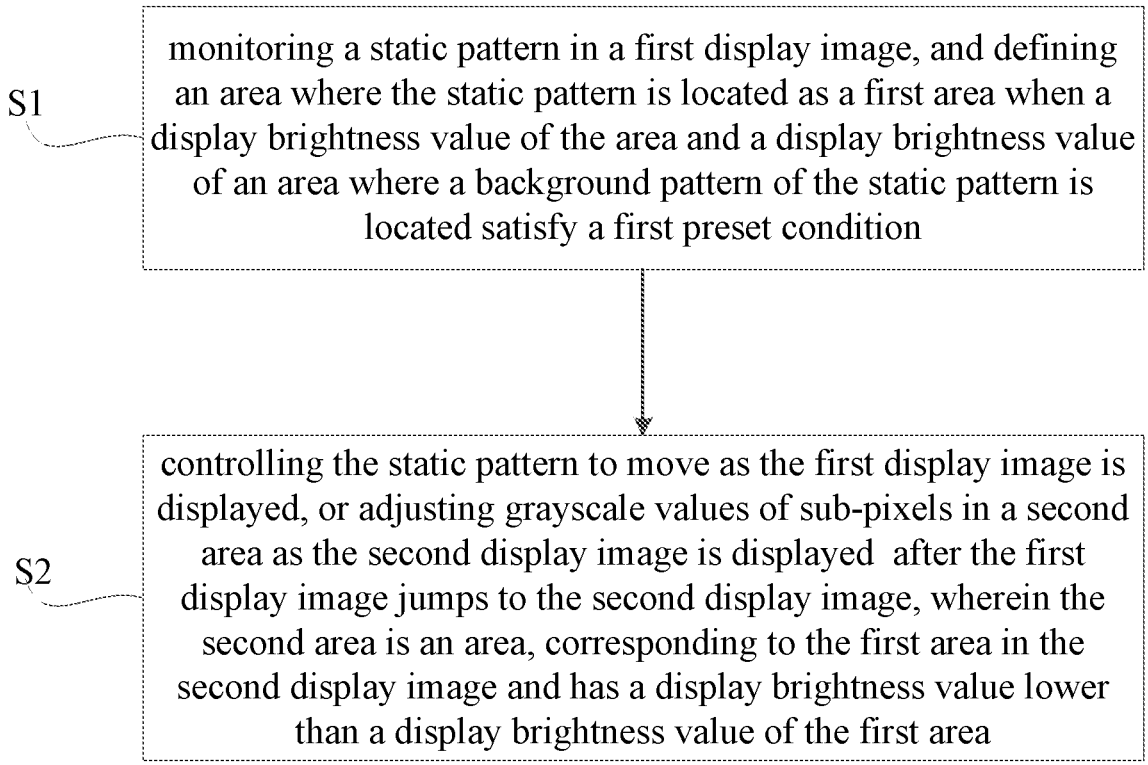
FIG. 2 is a flowchart of a method for driving a display panel according to an embodiment of the present disclosure.

Embodiments of the present disclosure provide a method for driving a display panel. FIG. 1 is a schematic diagram of a first display image and a second display image according to an embodiment of the present disclosure, and FIG. 2 is a flowchart of a method for driving a display panel according to an embodiment of the present disclosure. The method includes following steps.

Step S1: a static pattern in the first display image 1 is monitored, and an area where the static pattern 1 is located is defined as a first area 2 when a display brightness of the area where the static pattern is located and a display brightness of an area where a background pattern of the static pattern is located satisfy a first preset condition.

In the first display image 1, the display brightness of the area where the static pattern is located is relatively high and the display brightness of the area where the background pattern is located is relatively low. For example, with further reference to FIG. 1, the static pattern in the first display image 1 refers to a pattern "2" having a relatively high brightness in the image, and the background pattern refers to a pattern having a relatively low brightness around the periphery of the pattern "2".

Step S2: the static pattern is controlled to move during displaying of the first display image 1; or, grayscale values of the sub-pixels located in a second area 4 are adjusted during displaying of the second display image 3 after the first display image 1 jumps to the second display image 3, herein the second area 4 is an area, corresponding to the first area 2, in the second display image 3 and has a display brightness lower than the display brightness of the first area 2.

After the first display image 1 jumps to the second display image 3, an area, located at the same position as the first area 2, in the second display image 3 is defined as a second area 4 when this area has a display brightness lower than the previous display brightness of the first area 2. For example, again referring to FIG. 1, a part of the area displaying a pattern "8" in the second display image 3 is the second area 4.

During displaying of the first display image 1, since the display brightness of the area where the static pattern is located is relatively high, the driving transistor of the sub-pixel located in the first area 2 will keep receiving a fixed bias voltage for a long time if the location of the static pattern stays unchanged. As a result, after the image jumps, the display brightness of the second area 4 is relatively low, and the driving transistor in the second area 4 cannot be quickly switched to a next bias voltage. In this case, significant delay occurs, which leads to retention of the static pattern in the second area 4 before the image jumps, that is, the image retention occurs. However, in the method for driving the display panel according to this embodiment of the present disclosure, during displaying of the first display image 1, the bias voltage received by the driving transistor in the first area 2 can be constantly switched between a positive bias voltage and a negative bias voltage by controlling location of the static pattern to control movement thereof. In this way, it can be avoided that a certain bias voltage is kept received for a long time. Therefore, when the image jumps, the driving transistor in the first area 2 can be quickly switched to the next bias voltage, so that the display brightness of the second area 4 can approximate to desired standard display brightness. In this way, retention of the static pattern in the second area 4 can be avoided, thereby effectively ameliorating the image retention.

Alternatively, after the first display image 1 jumps to the second display image 3, the display brightness of the second area 4 is lower than the display brightness of the first area 2 during displaying of the second display image 3; and by adjusting grayscale values of the sub-pixels located in the second area 4, for example, by increasing grayscale values of some sub-pixels and thus increasing the brightness of these sub-pixels, a brightness difference between these sub-pixels in the first display image 1 and these sub-pixels in the second display image 3 can be reduced. In this way, when the area where these sub-pixels are located is switched between an image having high grayscale value and an image having low grayscale value, the resulted image retention can be effectively ameliorated.

It can be seen that, with the method for driving the display panel according to this embodiment of the present disclosure, the image retention occurring when the display panel is switched between an image having a high grayscale value and an image having a low grayscale value can be effectively ameliorated by controlling the static pattern in the first area 2 to move, or by adjusting the grayscale values of the sub-pixels in the second area 4. Therefore, the display performance can be improved.

In an embodiment, the display brightness value of the area where the static pattern is located is L1, the display brightness value of the area where the background pattern is located is L2, and the first preset condition is that $L1/L2>2000$.

It should be understood that the display brightness values of different areas in one display image are different, that is, for two adjacent areas, the display brightness of one area of the two adjacent areas is generally larger than the display brightness of the other area of the two adjacent areas. By using the first preset condition to define the ratio of L1 to L2, the area where the static pattern is located will be identified as the first area 2 only when L1/L2 is larger than or equal to 2000. In this way, identification errors can be avoided.

Figure 3:
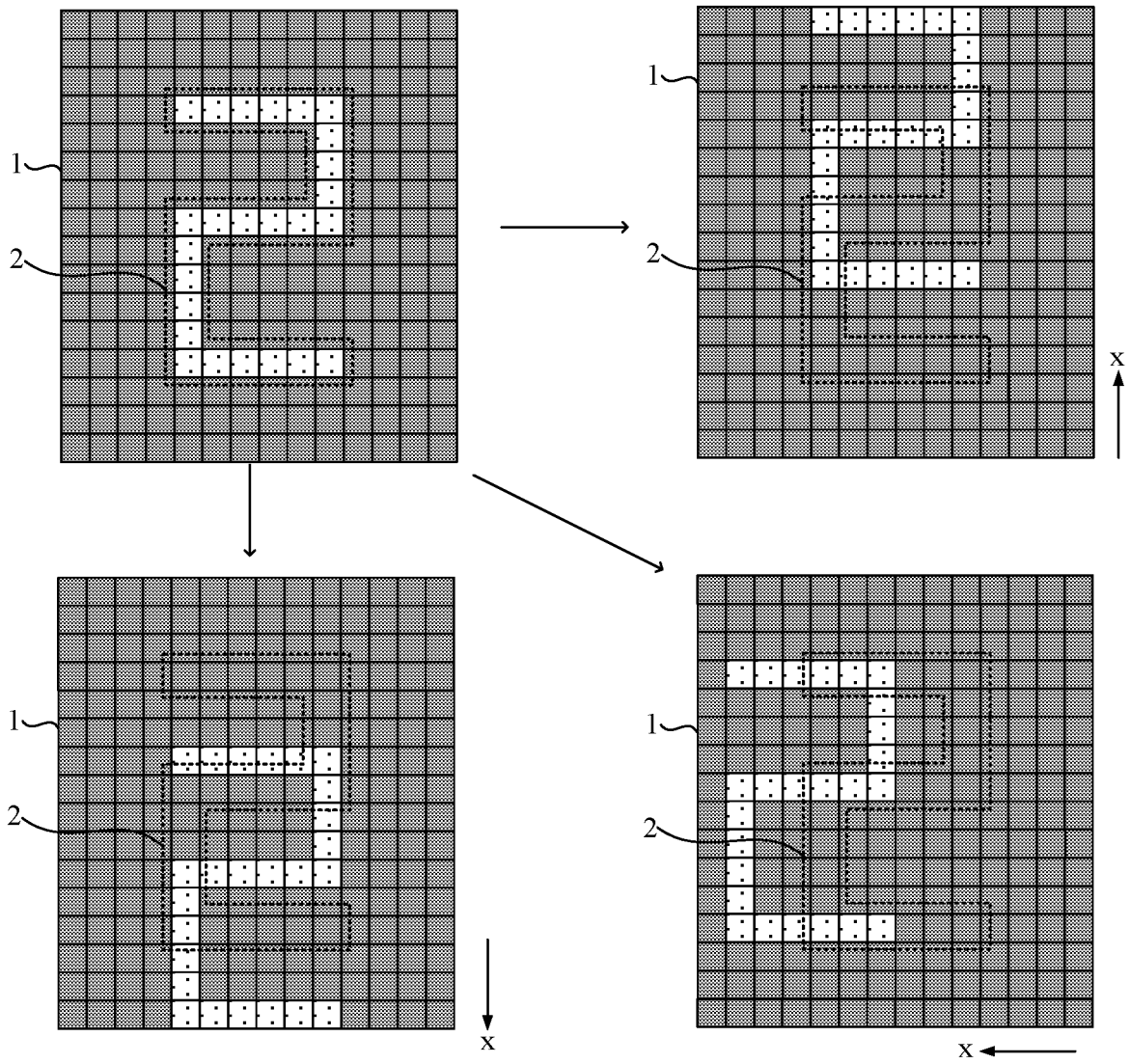
FIG. 3 is a schematic diagram of movement of a static pattern according to an embodiment of the present disclosure.

FIG. 3 is a schematic diagram of movement of a static pattern according to an embodiment of the present disclosure. Referring to FIG. 3, a process of controlling the static pattern to move includes: controlling the static pattern to move through $M_1$ sub-pixels along a direction x, herein $2 \leq M_1 \leq 16$.

It should be noted that the direction x may refer to any direction, that is, the static pattern can move through $M_1$ sub-pixels along any direction.

By controlling the static pattern to move through 2 to 16 sub-pixels, on the one hand, it can be avoided that the driving transistor of the sub-pixel located in the first area 2 keeps receiving a fixed bias voltage for a long time, thereby reducing the delay when switching the image, and on the other hand, it can ensure that the static pattern moves only around the periphery of the first area 2, thereby reducing the visibility of the movement of the static pattern to the human eyes, and thus improving the display effect.

In order to further shorten the time for the driving transistor of the first area 2 to maintain at a certain fixed bias voltage and further reduce the delay, in an embodiment, the movement of the static pattern is controlled to last for a time period of $N_1$, where $2s \leq N_1 \leq 10s$. That is, during displaying of the first display image 1, the image is controlled to jump to the second display image 3 after controlling the static pattern to move for a time period of $N_1$.

During this period of time, the static pattern at an original position can move back and forth along the direction x. For example, the static pattern moves downward from the original position by a distance of $M_1$ sub-pixels, then moves upward back to the original position, and then moves upward further by a distance of $M_1$ sub-pixels . . . , et cetera.

Figure 4:
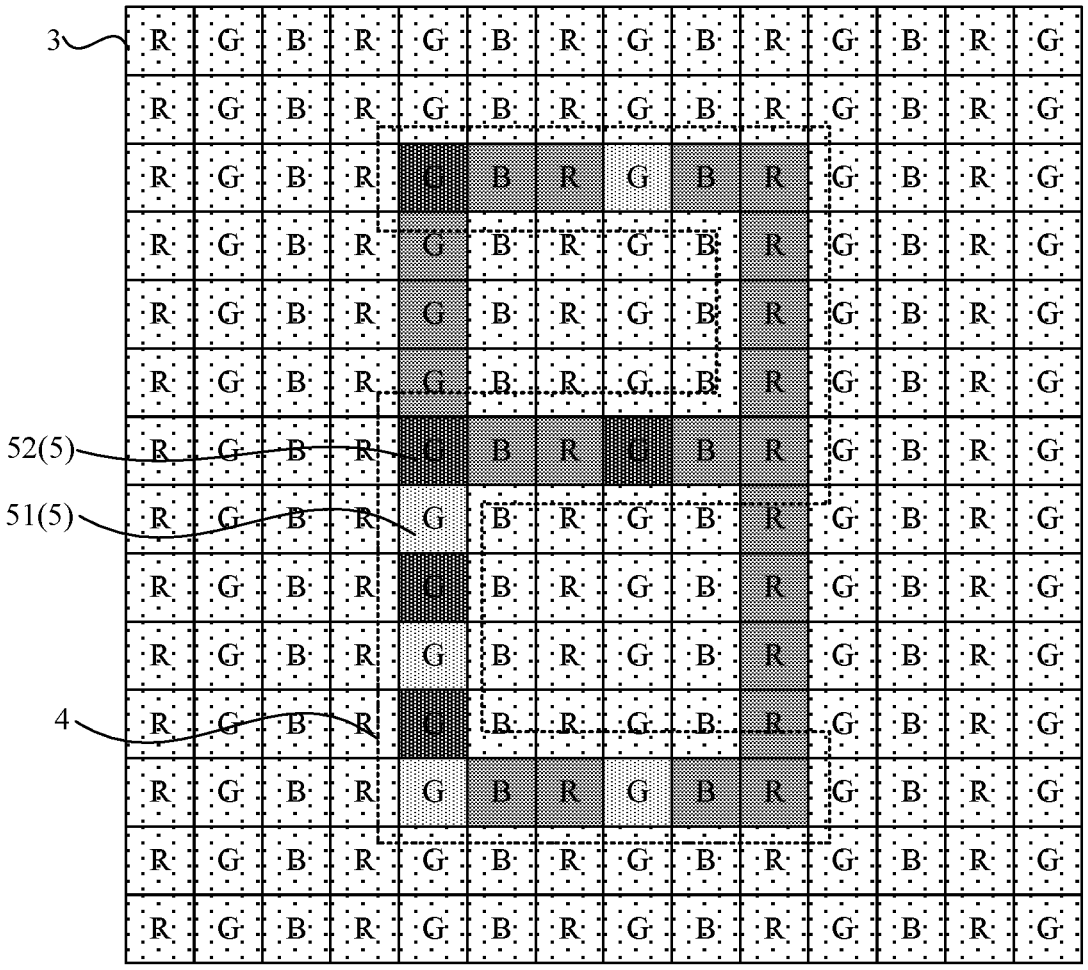
FIG. 4 is a schematic diagram showing a second area in which grayscale values of sub-pixels have been adjusted according to an embodiment of the present disclosure.

FIG. 4 is a schematic diagram showing a second area in which grayscale values of sub-pixels have been adjusted according to an embodiment of the present disclosure. Referring to FIG. 4, the process of adjusting grayscale values of sub-pixels in the second area 4 includes: adjusting grayscale values of $K_{g1}$ green sub-pixels 5 in the second area 4, so that the grayscale values of $K_{g2}$ green sub-pixels 5 are each $G_g$, and the grayscale values of $(K_{g1}-K_{g2})$ green sub-pixels 5 are each 0 (for easy distinguishing, in FIG. 4, the green sub-pixel 5 having the grayscale value of $G_g$ is denoted by reference number 51, and the green sub-pixel 5 having the grayscale value of 0 is denoted by reference number 52). A standard grayscale value of the green sub-pixel 5 in the second area 4 when the second display image 3 is normally displayed is $G_{gn}$, and $G_g > G_{gn}$.

For example, during displaying of the second display image 3, 100 green sub-pixels 5 are arranged in the second area 4 and the corresponding standard grayscale value is 50. Among the 100 green sub-pixels 5, the grayscale values of 20 green sub-pixels 5 are each adjusted to 94, and the grayscale values of the remaining 80 green sub-pixels 5 are each adjusted to 0.

It should be noted that, the specific numerical values of $K_{g2}$ and $G_g$, and the specific arrangement manner of the $K_{g2}$ green sub-pixels 5 having a grayscale value of $G_g$ and the $(K_{g1}-K_{g2})$ green sub-pixels 5 having a grayscale value of 0 are not limited in the embodiments of the present disclosure, and can be set according to actual needs.

After the grayscale values of the green sub-pixels 5 in the second area 4 are adjusted, for the $K_{g2}$ green sub-pixels 5 whose grayscale values are increased to $G_g$, increasing the grayscale values of these green sub-pixels 5 increases the luminous brightness thereof, thereby reducing a difference between a brightness of an area where these green sub-pixels are located in the first display image 1 and a brightness of the area in the second display image 3, and thus effectively ameliorating the image retention occurring in the area after the image jumps; for the $(K_{g1}-K_{g2})$ green sub-pixels 5 whose grayscale values are reduced to 0, an area where these green sub-pixels 5 are located are in a black state, and therefore the image retention will not occur in this area when the image jumps. It can be seen that by adjusting the grayscale values of the green sub-pixels 5 in the second area 4, the image retention of the area where the green sub-pixels 5 are located in the second area 4 can be effectively ameliorated.

In addition, by adjusting the grayscale values of some green sub-pixels 5 to be higher than the standard grayscale value $G_{gn}$ and adjusting the grayscale values of the remaining green sub-pixel 5 to be 0, a difference between a total brightness of all the green sub-pixels 5 in the second area 4 and a desired standard total brightness, thereby improving the display effect.

In addition, it should be noted that, compared with a red image and a blue image, a green image has the most serious image retention when the display panel is switched between an image having a high grayscale value and an image having a low grayscale value. Therefore, by adjusting the grayscale values of the green sub-pixels 5 in the second area 4, the image retention in the second area 4 can be ameliorated to a greater extent.

Further, the $(K_{g1}-K_{g2})$ green sub-pixels 5 whose grayscale values are adjusted to 0 are in a black state and the luminous brightness thereof is 0, therefore, in order to ensure that the total brightness of all the green sub-pixels 5 in the second area 4 after the grayscale value adjustment is the same as the desired standard total brightness so as to improve the display effect, the $K_{g2}$ and $G_g$ can be set such that the total brightness value of the $K_{g2}$ green sub-pixels 5 having a grayscale value of $G_g$ is equal to the total brightness value of the $K_{g1}$ green sub-pixels 5 having a grayscale value of $G_{gn}$.

Figure 5:
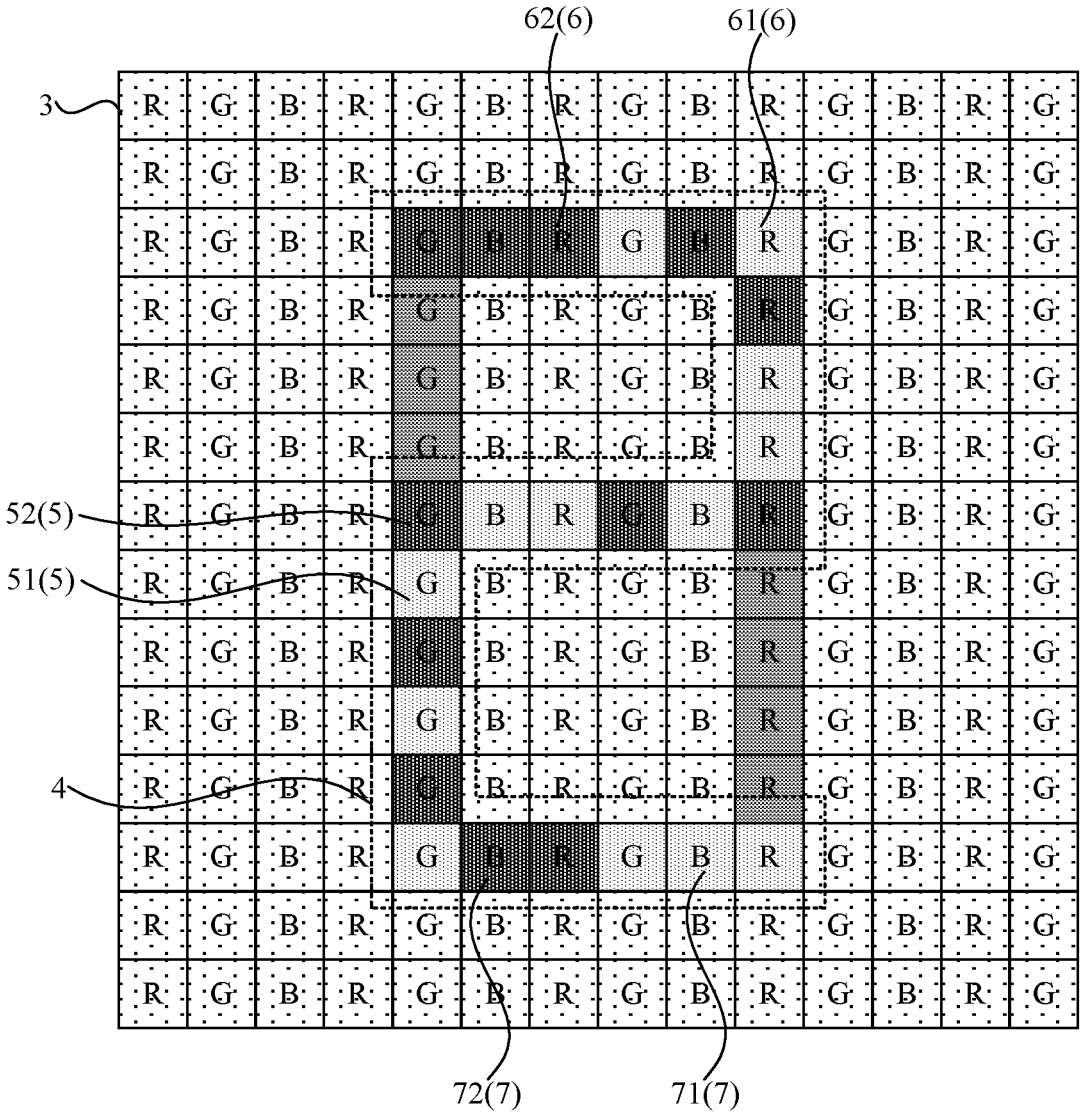
FIG. 5 is another schematic diagram showing a second area in which grayscale values of sub-pixels have been adjusted according to an embodiment of the present disclosure.

FIG. 5 is another schematic diagram showing a second area in which grayscale values of sub-pixels have been adjusted according to an embodiment of the present disclosure. Referring to FIG. 5, adjusting the grayscale values of the sub-pixels in the second area 4 may further include: adjusting grayscale values of $K_{r1}$ red sub-pixels 6 in the second area 4, so that grayscale values of $K_{r2}$ red sub-pixels 6 are each $G_r$, and grayscale values of $(K_{r1}-K_{r2})$ red sub-pixels 6 are each 0 (for easy distinguishing, in FIG. 5, the red sub-pixel 6 having the grayscale value of $G_r$ is denoted by reference number 61, and the red sub-pixel 6 having the grayscale value of 0 is denoted by reference number 62), where $G_r > G_{rn}$, and $G_{rn}$ is a standard grayscale value of the red sub-pixel 6 in the second area 4 when the second display image 3 is normally displayed; and/or, adjusting grayscale values of $K_{b1}$ blue sub-pixels 7 in the second area 4, so that grayscale values of $K_{b2}$ blue sub-pixels 7 are each $G_b$, and grayscale values of $(K_{b1}-K_{b2})$ blue sub-pixels 7 are each 0 (for easy distinguishing, in FIG. 5, the blue sub-pixel 7 having the grayscale value of $G_b$ is denoted by reference number 71, and the blue sub-pixel 7 having the grayscale value of 0 is denoted by reference number 72), where $G_b > G_{bn}$, and $G_{bn}$ is a standard grayscale value of the blue sub-pixel 7 in the second area 4 when the second display image 3 is normally displayed.

Similar to the green sub-pixels 5, the image retention in the area where the red sub-pixels 6 are located in the second area 4 can be effectively ameliorated by adjusting the grayscale values of the red sub-pixels 6 in the second area 4, and the image retention in the area where the blue sub-pixels 7 are located in the second area 4 can be effectively ameliorated by adjusting the grayscale values of the blue sub-pixels 6 in the second area 4. A detailed illustration can refer to the illustration of the green sub-pixels 5, and are not further described herein.

Further, in order to ensure that a total luminous brightness of all the red sub-pixels 6 in the second area 4 after the grayscale value adjustment is the same as a desired standard total luminous brightness, the $K_{r2}$ and $G_r$ can be set such that a total brightness value of the $K_{r2}$ red sub-pixels 6 having a grayscale value of $G_r$ is equal to a total brightness value of the $K_{r1}$ red sub-pixels 6 having a grayscale value of $G_{rn}$. Similarly, in order to ensure that a total luminous brightness of all the blue sub-pixels 7 in the second area 4 after the grayscale value adjustment is the same as a desired standard total luminous brightness, the $K_{b2}$ and $G_b$ can be set such that a total brightness value of the $K_{b2}$ blue sub-pixels 7 having a grayscale value of $G_b$ is equal to a total brightness value of the $K_{b1}$ blue sub-pixels 7 having a grayscale value of $G_{bn}$.

In an embodiment, in order to further effectively ameliorate the image retention, adjusting the grayscale values of the sub-pixels lasts for a time period of $N_2$, where $2s \leq N_2 \leq 10s$. That is, during displaying of the second display image 3, the image is controlled to jump to a subsequent image after adjusting the grayscale values of the sub-pixels lasts for a time period of $N_2$.

In addition, after adjusting the grayscale values of the sub-pixels, the method for driving the display panel may further include: controlling the pattern displayed in the second area 4 to move, thereby avoiding that the sub-pixels in the second area 4 keep emitting light for a long time, thereby improving the service life.

Further, in order to ensure that the pattern only moves around the periphery of the second area 4 so as to reduce the visibility of the movement of the pattern to the human eye, a process of controlling the pattern displayed in the second area 4 to move may include: controlling the pattern displayed in the second area 4 to move through $M_2$ sub-pixels along a direction x, where $2 \leq M_2 \leq 16$.

Figure 6:
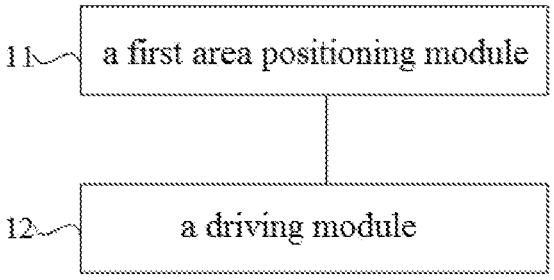
FIG. 6 is a schematic structural diagram of a driving chip according to an embodiment of the present disclosure.

An embodiment of the present disclosure further provides a driving chip. FIG. 6 is a schematic structural diagram of a driving chip according to an embodiment of the present disclosure. Referring to FIG. 6 in combination with FIG. 1, the driving chip includes a first area positioning module 11 and a driving module 12. The first area positioning module 11 is configured to monitor a static pattern in a first display image 1. When a display brightness value of an area where the static pattern is located and a display brightness value of an area where a background pattern of the static pattern is located satisfy a first preset condition, the area where the static pattern is located is defined as a first area 2. The driving module 12 is electrically connected to the first area positioning module 11 and is configured to control the static pattern to move during displaying of the first display image 1, or to adjust the grayscale values of the sub-pixels in a second area 4 during displaying of a second display image after the first display image 1 jumps to the second display image, the second area 4 being an area, corresponding to the first area 2 in the second display image 3 and having a display brightness lower than the display brightness of the first area 2.

With the driving chip according to this embodiment of the present disclosure, during displaying of the first display image 1, the bias voltage received by the driving transistor in the first area 2 can be constantly switched between a positive bias voltage and a negative bias voltage by controlling, by the driving module 12, the static pattern to move. In this way, it can be avoided that a certain bias voltage is kept received for an excessively long time. Therefore, when the image jumps, the driving transistor in the first area 2 can be quickly switched to a next bias voltage, so that the display brightness of the second area 4 can approximate to desired standard display brightness. In this way, retention of the static pattern in the second area 4 can be avoided, thereby effectively ameliorating the image retention. Alternatively, after the first display image 1 jumps to the second display image 3, grayscale values of the sub-pixels in the second area 4 are adjusted through the driving module 12, for example, grayscale values of some sub-pixels are increased and thus the brightness of these sub-pixels are increased, then a luminous brightness difference between these sub-pixel in the first display image 1 and these sub-pixel in the second display image 3 can be reduced. In this way, when the display panel is switched between an image having a high grayscale value and an image having a low grayscale value, image retention of an area where these sub-pixels are located can be effectively ameliorated. It can be seen that, with the driving chip according to this embodiment of the present disclosure, the image retention occuring when the display panel is switched between an image having a high grayscale value and an image having a low grayscale value can be effectively ameliorated. Therefore, the display performance can be improved.

Figure 7:
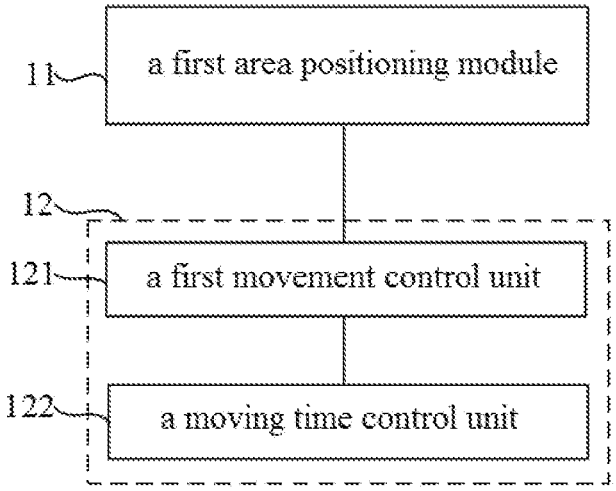
FIG. 7 is another schematic structural diagram of a driving chip according to an embodiment of the present disclosure.

FIG. 7 is another schematic structural diagram of a driving chip according to an embodiment of the present disclosure. Referring to FIG. 7 in combination with FIG. 3, when the driving module is configured to control the static pattern to move during displaying of the first display image 1, the driving module 12 may include a first movement control unit 121. The first movement control unit 121 is electrically connected to the first area positioning module 11 and is configured to control the static pattern to move through $M_1$ sub-pixels along the direction x, where $2 \leq M_1 \leq 16$.

The static pattern is controlled by the first movement control unit 121 to move through 2 to 16 sub-pixels. On the one hand, it can be avoided that the driving transistor of the sub-pixel in the first area 2 keeps receiving a fixed bias voltage for a long time, thereby reducing the delay when the image jumps, and on the other hand, it can ensure that the static pattern moves only around the periphery of the first area 2, thereby reducing the visibility of the movement of the static pattern to the human eyes, and thus improving the display effect.

In order to further shorten the time for the driving transistor of the first area 2 to maintain at a certain fixed bias voltage and further reduce the delay, again referring to FIG. 7, the driving module may further include a moving time control unit 122. The moving time control unit 122 is electrically connected to the first movement control unit to drive the first movement control unit, so that the first movement control unit can control the movement of the static pattern to last for a time period of $N_1$, where $2s \leq N_1 \leq 10s$.

Figure 8:
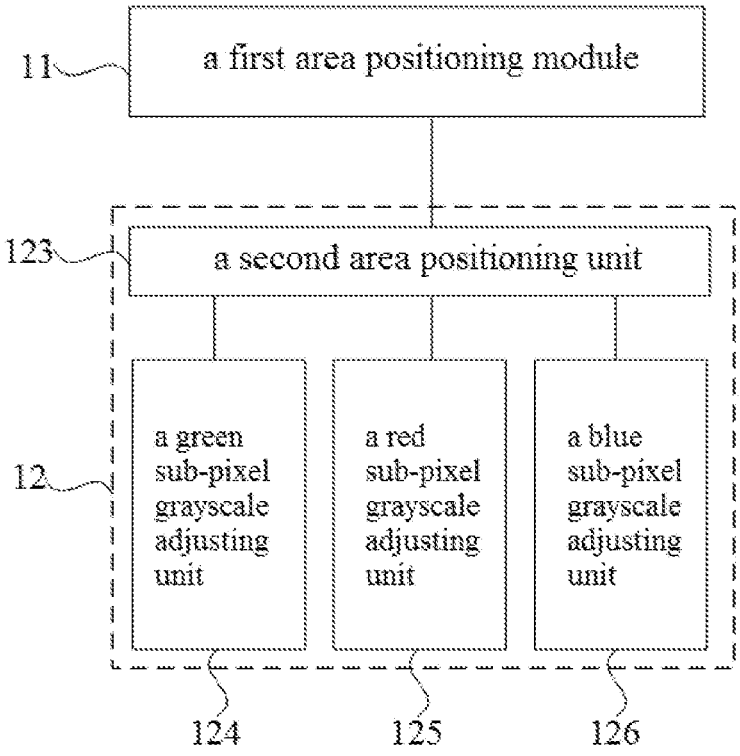
FIG. 8 is still another schematic structural diagram of a driving chip according to an embodiment of the present disclosure.

FIG. 8 is still another schematic structural diagram of a driving chip according to an embodiment of the present disclosure. Referring to FIG. 8 in combination with FIG. 4, when the driving module 12 is configured to adjust the grayscale values of the sub-pixels in the second area 4 during displaying of the second display image 3, the driving module 12 may include a second area positioning unit 123 and a green sub-pixel grayscale adjusting unit 124.

The second area positioning unit 123 is electrically connected to the first area positioning module 11, and is configured to define an area, corresponding to the first area 2, in the second display image 3 and having a display brightness value lower than the display brightness value of the first area 2 as a second area 4 during displaying of the second display image 3. The green sub-pixel grayscale adjusting unit 124 is electrically connected to the second area positioning unit 123 and is configured to adjust grayscale values of $K_{g1}$ green sub-pixels 5 in the second area 4, so that grayscale values of $K_{g2}$ green sub-pixels 5 are each $G_g$, and grayscale values of ($K_{g1}$-$K_{g2}$) green sub-pixels 5 are each 0, where $G_g > G_{gn}$, $G_{gn}$ is a standard grayscale value of the green sub-pixels 5 in the second area 4 when the second display image 3 is normally displayed, and the $K_{g2}$ and $G_g$ satisfy that a total brightness value of the $K_{g2}$ green sub-pixels 5 having a grayscale value of $G_g$ is equal to a total brightness value of the $K_{g1}$ green sub-pixels 5 having a grayscale value of $G_{gn}$.

The grayscale values of the $K_{g1}$ green sub-pixels 5 in the second area 4 are adjusted by the green sub-pixel grayscale adjusting unit 124. For the $K_{g2}$ green sub-pixels 5 whose grayscale values are increased to $G_g$, increasing the grayscale values of these green sub-pixels 5 can increase the luminous brightness thereof, thereby reducing a brightness difference of an area where these green sub-pixels 5 are located between the first display image 1 and the second display image 3, and thus effectively ameliorating the image retention occurring in this area after the image jumps; for the ($K_{g1}$-$K_{g2}$) green sub-pixels 5 whose grayscale values are reduced to 0, the area where these green sub-pixels 5 are located are in a black state, and therefore the image retention will not occur in this area when the image jumps. It can be seen that by adjusting the grayscale values of the green sub-pixels 5 in the second area 4, the image retention in the area where the green sub-pixels 5 are located in the second area 4 can be effectively ameliorated.

Further, again referring to FIG. 8, the driving module 12 may further include a red sub-pixel grayscale adjusting unit 125 and/or a blue sub-pixel grayscale adjusting unit 126.

The red sub-pixel grayscale adjusting unit 125 is electrically connected to the second area positioning unit 123 and is configured to adjust grayscale values of $K_{r1}$ red sub-pixels 6 in the second area 4, so that grayscale values of $K_{r2}$ red sub-pixels 6 are each $G_r$, and grayscale values of ($K_{r1}$-$K_{r2}$) red sub-pixels 6 are each 0, where $G_r > G_{rn}$, $G_{rn}$ is a standard grayscale value of the red sub-pixels 6 in the second area 4 when the second display image 3 is normally displayed, and the $K_{r2}$ and $G_r$ satisfy that a total brightness value of the $K_{r2}$ red sub-pixels 6 having a grayscale value of $G_r$ is equal to a total brightness value of the $K_{r1}$ red sub-pixels 6 having a grayscale value of $G_{rn}$.

The blue sub-pixel grayscale adjusting unit 126 is electrically connected to the second area positioning unit 123 and is configured to adjust grayscale values of $K_{b1}$ blue sub-pixels 7 in the second area 4, so that grayscale values of $K_{b2}$ blue sub-pixels 7 are each $G_b$, and grayscale values of ($K_{b1}$-$K_{b2}$) blue sub-pixels 7 are each 0, where $G_b > G_{bn}$, $G_{bn}$ is a standard grayscale value of the blue sub-pixels 7 in the second area 4 when the second display image 3 is normally displayed, and the $K_{b2}$ and $G_b$ satisfy that a total brightness value of the $K_{b2}$ blue sub-pixels 7 having a grayscale value of $G_b$ is equal to a total brightness value of the $K_{b1}$ blue sub-pixels 7 having a grayscale value of $G_{bn}$.

Similar to the green sub-pixels 5, the image retention in the area where the red sub-pixels 6 are located in the second area 4 can be effectively ameliorated by adjusting the grayscale values of the red sub-pixels 6 in the second area 4, and the image retention in the area where the blue sub-pixels 7 are located in the second area 4 can be effectively ameliorated by adjusting the grayscale values of the blue sub-pixels 6 in the second area 4.

Figure 9:
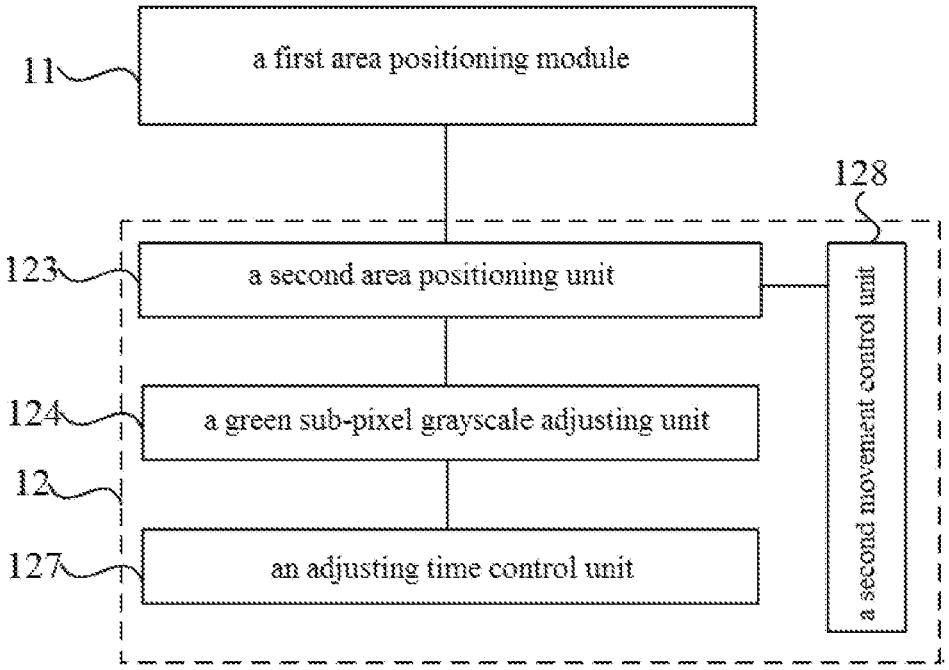
FIG. 9 is yet another schematic structural diagram of a driving chip according to an embodiment of the present disclosure.

FIG. 9 is yet another schematic structural diagram of a driving chip according to an embodiment of the present disclosure. In order to further effectively ameliorate the image retention, as shown in FIG. 9, the driving module 12 may further include an adjusting time control unit 127. The adjusting time control unit 127 is electrically connected to the green sub-pixel grayscale adjusting unit 124 to drive the green sub-pixel grayscale adjusting unit 124, so that the green sub-pixel grayscale adjusting unit 124 can keep adjusting grayscale values of the green sub-pixels for a time period of $N_2$, where $2s \le N_2 \le 10s$.

Further, in order to ensure that the pattern moves only around the periphery of the second area 4 and reduce the visibility of movement of the pattern to the human eyes, again referring to FIG. 9, the driving module 12 may further include a second movement control unit 128. The second movement control unit 128 is electrically connected to the second area positioning unit 123 and is configured to control the pattern displayed in the second area 4 to move through $M_2$ sub-pixels along the direction x, where $2 \le M_2 \le 16$.

Figure 10:
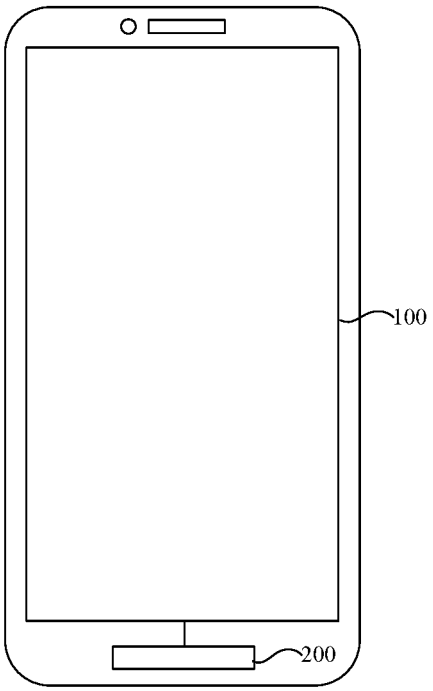
FIG. 10 is a schematic structural diagram of a display device according to an embodiment of the present disclosure.

Embodiments of the present disclosure further provide a display device. FIG. 10 is a schematic structural diagram of a display device according to an embodiment of the present disclosure. As shown in FIG. 10, the display device includes a display panel 100 and the above-mentioned driving chip 200, and the driving chip 200 is electrically connected to the display panel 100. The structure of the driving chip 200 has been described in detail in the above embodiments, and will not be further described herein. It should be noted that, the display device shown in FIG. 10 is merely illustrative, and the display device may be any electronic device having a display function, such as a cellphone, a tablet computer, a notebook computer, an e-book, or a television.

The display device provided by the embodiments of the present disclosure includes the driving chip 200 described above. Therefore, with this display device, the image retention occurring when the display panel is switched between an image having a high grayscale value and an image having a low grayscale value can be effectively ameliorated by controlling the static pattern in the first area 2 to move, or by adjusting the grayscale values of the sub-pixel in the second area 4. Therefore, the display performance can be improved The above-described embodiments are merely illustrative and are not intended to limit the present disclosure. Any modifications, equivalent substitutions and improvements made within the principle of the present disclosure shall fall into the protection scope of the present disclosure.

What is claimed is:

1. A method for driving a display panel, comprising:

monitoring a static pattern in a first display image, and defining an area where the static pattern is located as a first area when a display brightness value L1 of the area and a display brightness value L2 of an area where a background pattern of the static pattern is located satisfy: L1/L2>2000; and controlling the static pattern to move as the first display image is displayed, or adjusting grayscale values of sub-pixels in a second area as the second display image is displayed after the first display image jumps to the second display image, wherein the second area is an area, corresponding to the first area in the second display image and has a display brightness value lower than a display brightness value of the first area.

2. The method according to claim 1, wherein said controlling the static pattern to move comprises:

controlling the static pattern to move through $M_1$ sub-pixels along a direction x, where $2 \le M_1 \le 16$.

3. The method according to claim 1, wherein the static pattern is controlled to move for a time period of $N_1$, where $2s \le N_1 \le 10s$.

4. The method according to claim 1, wherein said adjusting the grayscale values of the sub-pixels in the second area comprises:

adjusting grayscale values of $K_{g1}$ green sub-pixels in the second area, so that grayscale values of $K_{g2}$ green sub-pixels of the $K_{g1}$ green sub-pixels are each $G_g$, and grayscale values of remaining ($K_{g1}$-$K_{g2}$) green sub-pixels of the $K_{g1}$ green sub-pixels are each 0, wherein $G_g > G_{gn}$, and $G_{gn}$ is a standard grayscale value of the $K_{g1}$ green sub-pixels in the second area when the second display image is displayed.

5. The method according to claim 4, wherein a total brightness value of the $K_{g2}$ green sub-pixels having the grayscale value of $G_g$ is equal to a total brightness value of the $K_{g1}$ green sub-pixels having the grayscale value of $G_{gn}$.

6. The method according to claim 5, wherein said adjusting the grayscale values of the sub-pixels in the second area further comprises:

adjusting grayscale values of $K_{r1}$ red sub-pixels in the second area, so that grayscale values of $K_{r2}$ red sub-pixels of the $K_{r1}$ red sub-pixels are each $G_r$, and grayscale values of remaining ($K_{r1}$-$K_{r2}$) red sub-pixels of the $K_{r1}$ red sub-pixels are each 0, wherein $G_r > G_{rn}$, and $G_{rn}$ is a standard grayscale value of the $K_{r1}$ red sub-pixels in the second area when the second display image is displayed; and/or adjusting grayscale values of $K_{b1}$ blue sub-pixels in the second area, so that grayscale values of $K_{b2}$ blue sub-pixels of the $K_{b1}$ blue sub-pixels are each $G_b$, and grayscale values of remaining ($K_{b1}$-$K_{b2}$) blue sub-pixels of the $K_{b1}$ blue sub-pixels are each 0, wherein $G_b > G_{bn}$, and $G_{bn}$ is a standard grayscale value of the $K_{b1}$ blue sub-pixels in the second area when the second display image is displayed.

7. The method according to claim 6, wherein a total brightness value of the $K_{r2}$ red sub-pixels having the grayscale value of $G_r$ is equal to a total brightness value of the $K_{r1}$ red sub-pixels having the grayscale value of $G_m$; and a total brightness value of the $K_{b2}$ blue sub-pixels having the grayscale value of $G_b$ is equal to a total brightness value of the $K_{b1}$ blue sub-pixels having the grayscale value of $G_{bn}$.

8. The method according to claim 1, wherein said adjusting the grayscale values of the sub-pixels in the second area lasts for a time period of $N_2$, where $2s \le N_2 \le 10s$.

9. The method according to claim 1, further comprising, after adjusting the grayscale values of the sub-pixels in the second area during displaying of the second display image:

controlling a pattern displayed in the second area to move.

10. The method according to claim 9, wherein said controlling the pattern displayed in the second area to move comprises:

controlling the pattern displayed in the second area to move through $M_2$ sub-pixels along a direction x, where $2 \le M_2 \le 16$.

11. A driving chip, comprising:

a first area positioning circuit configured to monitor a static pattern in a first display image, and to define an area where the static pattern is located as a first area when a display brightness value L1 of the area and a display brightness value L2 of an area where a background pattern of the static pattern is located satisfy: $L1/L2 \ge 2000$; and a driving circuit electrically connected to the first area positioning circuit, and configured to control the static pattern to move as the first display image is displayed, or to adjust grayscale values of sub-pixels in a second area as the second display image is displayed after the first display image jumps to the second display image, wherein the second area is an area, corresponding to the first area in the second display image and has a display brightness value lower than a display brightness value of the first area.

12. The driving chip according to claim 11, wherein the driving circuit comprises:

a first movement control unit electrically connected to the first area positioning circuit and configured to control the static pattern to move through $M_1$ sub-pixels along a direction x, where $2 \le M_1 \le 16$.

13. The driving chip according to claim 12, wherein the driving circuit further comprises:

a moving time control unit electrically connected to the first movement control unit and configured to drive the first movement control unit, so that the first movement control unit controls the static pattern to move for a time period of $N_1$, where $2s \le N_1 \le 10s$.

14. The driving chip according to claim 11, wherein the driving circuit comprises:

a second area positioning unit electrically connected to the first area positioning circuit, and configured to define the area, corresponding to the first area in the second display image and has a display brightness value lower than a display brightness value of the first area as the second area during displaying of the second display image; and a green sub-pixel grayscale adjusting unit electrically connected to the second area positioning unit, and configured to adjust grayscale values of $K_{g1}$ green sub-pixels in the second area, so that grayscale values of $K_{g2}$ green sub-pixels of the $K_{g1}$ green sub-pixels are each $G_g$, and grayscale values of remaining ($K_{g1}$-$K_{g2}$) green sub-pixels of the $K_{g1}$ green sub-pixels are each 0;

wherein $G_g > G_{gn}$, and $G_{gn}$ is a standard grayscale value of the $K_{g1}$ green sub-pixels in the second area when the second display image is displayed, and a total brightness value of the $K_{g2}$ green sub-pixels having the grayscale value of $G_g$ is equal to a total brightness value of the $K_{g1}$ green sub-pixels having the grayscale value of $G_{gn}$.

15. The driving chip according to claim 14, wherein the driving circuit further comprises:

a red sub-pixel grayscale adjusting unit electrically connected to the second area positioning unit, and configured to adjust grayscale values of $K_{r1}$ red sub-pixels in the second area, so that grayscale values of $K_{r2}$ red sub-pixels of the $K_{r1}$ red sub-pixels are each $G_r$, and grayscale values of remaining ($K_{r1}$-$K_{r2}$) red sub-pixels of the $K_{r1}$ red sub-pixels are each 0, wherein $G_r > G_{rn}$, and $G_{rn}$ is a standard grayscale value of the $K_{r1}$ red sub-pixels in the second area when the second display image is displayed, and a total brightness value of the $K_{r2}$ red sub-pixels having the grayscale value of $G_r$ is equal to a total brightness value of the $K_{r1}$ red sub-pixels having the grayscale value of $G_{rn}$; and/or a blue sub-pixel grayscale adjusting unit electrically connected to the second area positioning unit, and configured to adjust grayscale values of $K_{b1}$ blue sub-pixels in the second area, so that grayscale values of $K_{b2}$ blue sub-pixels of the $K_{b1}$ blue sub-pixels are each $G_b$, and grayscale values of remaining ($K_{b1}$-$K_{b2}$) blue sub-pixels of the $K_{b1}$ blue sub-pixels are each 0, wherein $G_b > G_{bn}$, $G_{bn}$ is a standard grayscale value of the $K_{b1}$ blue sub-pixels in the second area when the second display image is displayed, and that a total brightness value of the $K_{b2}$ blue sub-pixels having the grayscale value of $G_b$ is equal to a total brightness value of the $K_{b1}$ blue sub-pixels having the grayscale value of $G_{bn}$.

16. The driving chip according to claim 14, wherein the driving circuit further comprises:

an adjusting time control unit electrically connected to the green sub-pixel grayscale adjusting unit, and configured to drive the green sub-pixel grayscale adjusting unit so that the green sub-pixel grayscale adjusting unit keeps adjusting the grayscale values of the $K_{g1}$ green sub-pixels in the second area for a time period of $N_2$, where $2s \leq N_2 10s$.

17. The driving chip according to claim 14, wherein the driving circuit further comprises:

a second movement control unit electrically connected to the second area positioning unit, and configured to control a pattern displayed in the second area to move through $M_2$ sub-pixels along a direction x, where $2 \leq M_2 \leq 16$.

18. A display device, comprising:

a display panel; and a driving chip electrically connected to the display panel, wherein the driving chip comprises:

a first area positioning circuit configured to monitor a static pattern in a first display image, and to define an area where the static pattern is located as a first area when a display brightness value L1 of the area and a display brightness value L2 of an area where a background pattern of the static pattern is located satisfy: $L1/L2 \geq 2000$; and a driving circuit electrically connected to the first area positioning circuit, and configured to control the static pattern to move during displaying of the first display image, or to adjust grayscale values of sub-pixels in a second area during displaying of a second display image after the first display image jumps to the second display image, wherein the second area is an area, corresponding to the first area in the second display image and has a display brightness value lower than a display brightness value of the first area.

* * * * *